US006974024B2

(12) United States Patent
Cho

(10) Patent No.: US 6,974,024 B2
(45) Date of Patent: Dec. 13, 2005

(54) CAP DEVICE FOR MIXING DIFFERENT KINDS OF MATERIALS SEPARATELY CONTAINED THEREIN AND IN BOTTLE

(76) Inventor: Young Kook Cho, 3090 E. 50th St., Vernon, CA (US) 90052

( * ) Notice: Subject to any disclaimer, the term of this patent is extended or adjusted under 35 U.S.C. 154(b) by 106 days.

(21) Appl. No.: 10/683,996

(22) Filed: Oct. 14, 2003

(65) Prior Publication Data

US 2004/0200740 A1 Oct. 14, 2004

(30) Foreign Application Priority Data

Apr. 12, 2003 (KR) ..... 10-2003-0023242

(51) Int. Cl.[7] ..... B65D 25/08
(52) U.S. Cl. ..... 206/219; 206/221; 222/83; 222/129
(58) Field of Search ..... 206/219, 221, 206/222; 215/DIG. 8; 222/83, 129, 80, 81

(56) References Cited

U.S. PATENT DOCUMENTS 4,315,570 A * 2/1982 Silver et al. ..... 206/221
4,513,861 A * 4/1985 Baram ..... 206/219
6,533,113 B2 * 3/2003 Moscovitz ..... 206/222
6,705,491 B1 * 3/2004 Lizerbram et al. ..... 222/145.1
6,735,939 B2 * 5/2004 Surnilla ..... 60/285
2004/0007481 A1 * 1/2004 Kiser ..... 206/219
2004/0154937 A1 * 8/2004 Cho ..... 206/219
2004/0200741 A1 * 10/2004 Cho ..... 206/219

* cited by examiner

*Primary Examiner*—David T. Fidei
(74) *Attorney, Agent, or Firm*—Jerry H. Noh

(57) ABSTRACT

A cap device for bottles, which is capable of mixing an additive contained therein with a material contained in a bottle to prepare a mixture in accordance with a simple rotating action of the cap device relative to the bottle, performed by a user, thus allowing the user to easily prepare the mixture just before drinking or using the mixture. The cap device also allows the mixture to be quickly discharged from the container. The cap device for bottles of the present invention includes a valve unit closely and removably fitted over a mouth of a bottle. An additive containing unit externally and removably engages with the valve unit, and the additive containing unit defines a cavity therein to contain an additive.

2 Claims, 9 Drawing Sheets

CAP DEVICE FOR MIXING DIFFERENT KINDS OF MATERIALS SEPARATELY CONTAINED THEREIN AND IN BOTTLE

BACKGROUND OF THE INVENTION

1. Field of the Invention

The present invention relates, in general, to a cap for bottles which is capable of quickly mixing different kinds of materials to prepare a mixture and, more particularly, to a cap device for bottles, which allows a user to mix an additive contained in the cap device with a material contained in a bottle to prepare a mixture by simply rotating the cap device relative to the bottle, thus easily preparing the mixture just before drinking or using the mixture.

2. Description of the Related Art

In the prior art, most conventional disposable bottles circulated and sold in markets each contain therein only a single kind of material, such as a drink, a liquid medicine or a liquid chemical, and are closed by caps at the mouths thereof.

When a user wants to add an additive to the material contained in such a capped bottle so as to prepare a mixture prior to drinking or using the mixture, the user must add the additive from a separate container to the bottled material after removing a cap from the bottle. Therefore, it is necessary for manufacturers of the additives and the bottled materials to separately contain such additives and materials in separate containers and bottles prior to marketing them, thus wasting natural resources due to the production of the separate containers and capped bottles. In addition, the adding of the additive from the separate container to the bottled material to mix them after removing the cap from the bottle is inconvenient to the user in that the user is forced to separately purchase and handle the additive container and the bottle. Furthermore, it is extremely difficult for the user to add a precise amount of the additive from the separate container to the material contained in the bottle, and as such, the user roughly measures the amount of the additive to be added to the bottled material. Therefore, in the case of mixing an additive with a bottled drink to produce a mixed beverage, the rough measurement of the amount of the additive may result in change in the taste and quality of the mixed beverage. In the case of mixing an additive with a bottled liquid medicine or a bottled liquid chemical to produce a mixed medicine or a mixed chemical, the rough measurement of the amount of the additive may result in incomplete dissolution of effective ingredients of the additive in the medicine or the chemical and a failure of accomplishment of desired medical or chemical effects of the mixed medicine or the mixed chemical.

Of course, when mixtures are prepared by manufacturers at factories and are marketed in a bottled state, in place of allowing users to mix additives with bottled materials to prepare mixtures just before drinking or using the mixtures, it is possible to avoid the above-described problems experienced in the mixing of the additives with the bottled materials performed by the users. However, the mixtures which are prepared by the manufacturers and marketed in the bottled state are problematic in that the properties of ingredients of the bottled mixtures may be gradually degraded as time goes by, in addition to change in colors of the mixtures. Furthermore, the bottled mixtures may generate floating matters and deposits therein with passage of time.

In addition, it is impossible to freely use a conventional cap with containers and bottles having no threads at the outer surface of the mouths thereof, such as test tubes. Thus, it is necessary to provide a means capable of allowing a cap to be freely used with a variety of containers regardless of presence of threads at the mouths thereof.

SUMMARY OF THE INVENTION

Accordingly, the present invention has been made keeping in mind the above problems occurring in the prior art, and an object of the present invention is to provide a cap device for bottles, which allows the additive and the bottled material to be maintained in their respective pure states without being mixed together before a user adds the additive to the bottled material, thus being free from physical or chemical problems of degradation in the properties of ingredients, change in colors, and a generation of floating matters and deposits experienced in conventional bottled mixtures marketed in a bottled state.

Another object of the present invention is to provide a cap device for bottles, which does not force the user to separately purchase and handle an additive container and a bottle containing the material, thus being convenient to the user, and which is free from excessive consumption of labor, time and natural resources due to the separate production of the containers for additives and capped bottles.

A further object of the present invention is to provide a cap device for bottles, which allows the user to mix the precise amount of the additive with the bottled material to prepare the mixture, so that it is possible to prevent variations in the taste and quality of the mixture in the case of preparing a mixed beverage through the mixing, and to prevent incomplete dissolution of effective ingredients of the additive in the bottled material or a failure of accomplishment of desired medical or chemical effects of the mixture in the case of preparing a mixed medicine or a mixed chemical through the mixing.

Yet another object of the present invention is to provide a cap device for bottles, which allows the mixture to be quickly discharged from the container.

Still another object of the present invention is to provide a cap device for bottles, which is freely used with containers having no threads at the mouths thereof, such as test tubes, and bottles having threads at the mouths thereof.

In order to accomplish the above objects, the present invention provides a cap device for bottles, comprising: a valve unit closely and removably fitted over a mouth of a bottle; and an additive containing unit defining a cavity therein to contain an additive in the cavity, and externally and removably engaging with the valve unit.

In an embodiment, the valve unit comprises: a double-walled cylindrical valve body having double sidewalls, with an annular space defined between the sidewalls of the valve body to receive the mouth of the bottle therein; a conical valve part provided at a center of an opening formed at a top wall of the double-walled cylindrical valve body; a plurality of radial ribs extending outward from an external surface of the conical valve part in radial directions; and a funnel part provided at a predetermined position in the additive containing unit, such that a lower end of the funnel part is brought into close contact with or spaced apart from the conical valve part.

In another embodiment, the valve unit comprises: a cap body tightened at lower internal threads thereof to the mouth of the bottle through a screw-type engagement; a conical valve part formed at an intermediate portion in the cap body; and a funnel part provided at a lower portion of the additive containing unit, with external threads formed at the lower portion of the additive containing unit to engage with upper internal threads of the cap body, such that an open lower end of the funnel part comes into close contact with the conical valve part of the cap body.

BRIEF DESCRIPTION OF THE DRAWINGS

The above and other objects, features and other advantages of the present invention will be more clearly understood from the following detailed description taken in conjunction with the accompanying drawings, in which:

FIG. 1*b* is an exploded sectional view showing the construction of the cap device of FIG. 1*a;*

DETAILED DESCRIPTION OF THE INVENTION

Figure 1A:
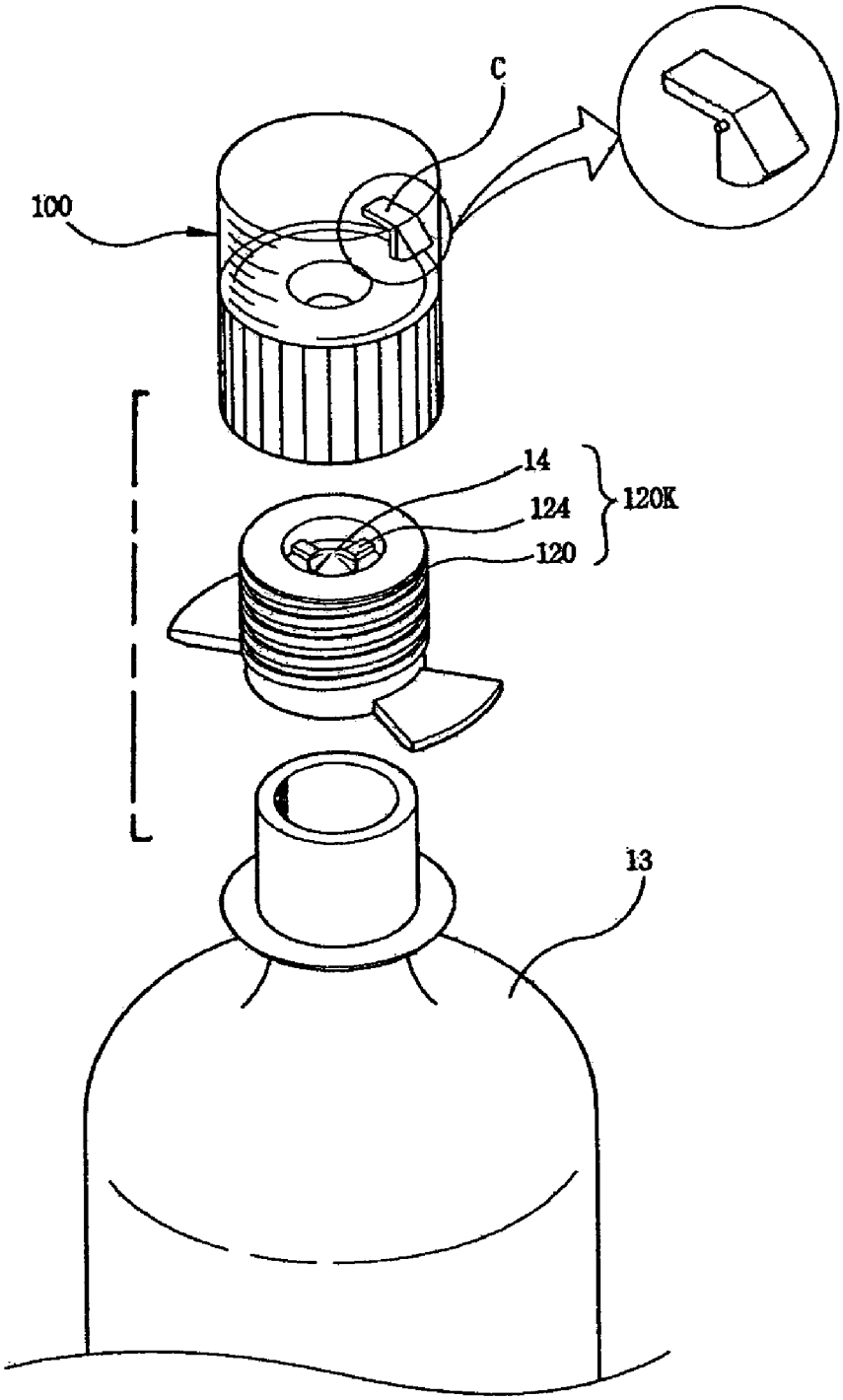
FIG. 1*a* is an exploded perspective view showing the construction of a cap device for bottles, according to a first embodiment of the present invention.
Figure 16:
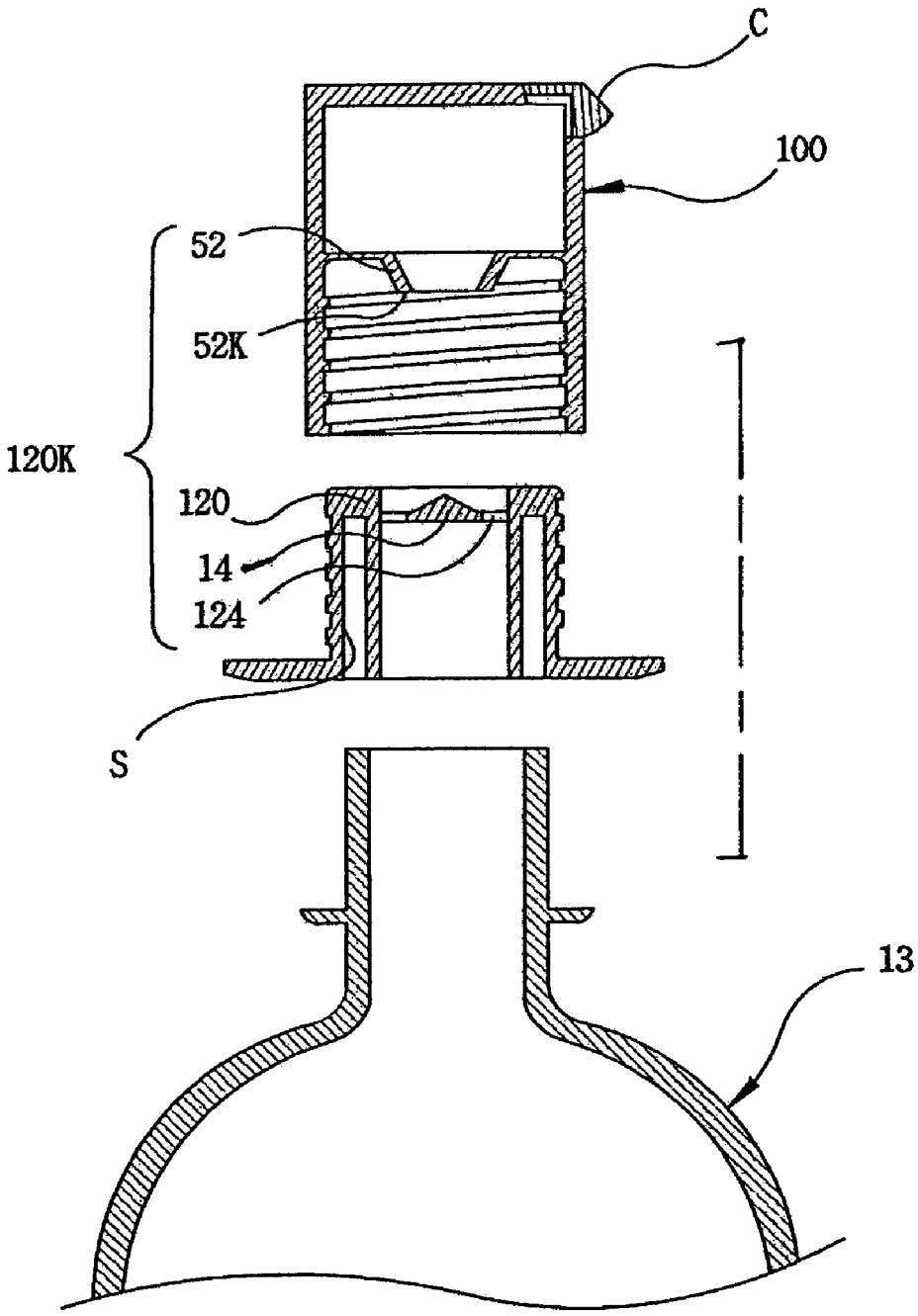

Reference should now be made to the drawings, in which the same reference numerals are used throughout the different drawings to designate the same or similar components.

First Embodiment

FIGS. 1*a*, 1*b*, 2*a*, 2*b*, 3*a*, 3*b*, and 3*c* are views showing a cap device for bottles, according to the first embodiment of the present invention. As shown in the drawings, the cap device according to the first embodiment comprises an additive containing unit 100 having a threaded inner surface and defining a cavity therein to act as a container for an additive, and a valve unit 120K acting as a valve means to open or close the cavity of the additive containing unit 100. The cap device of this first embodiment is used with a bottle 13, of which the mouth does not have internal or external threading. That is, a double-walled cylindrical valve body 120 of the valve unit 120K is closely fitted over the non-threaded mouth of the bottle 13. Of course, it is possible to remove the valve body 120 from the mouth of the bottle, when necessary. The additive containing unit 100 defines the cavity therein to contain an additive, and externally and removably engages at its inner threaded surface to external threaded surface of the valve body 120.

The valve unit 120K comprises the double-walled cylindrical valve body 120 having both a conical valve part 14 and a plurality of radial ribs 124 connecting the valve part 14 to the valve body 120. The valve unit 120K also comprises a funnel part 52 provided in the additive containing unit 100.

The cylindrical valve body 120 has double sidewalls, with an annular space "S" defined between the sidewalls of the valve body 120 to receive the non-threaded mouth of the bottle 13 therein. The conical valve part 14 is provided at the center of an opening formed in the top wall of the valve body 120, and the radial ribs 124 extend outward from the external surface of the conical valve part 14 in radial directions.

Figure 2A:
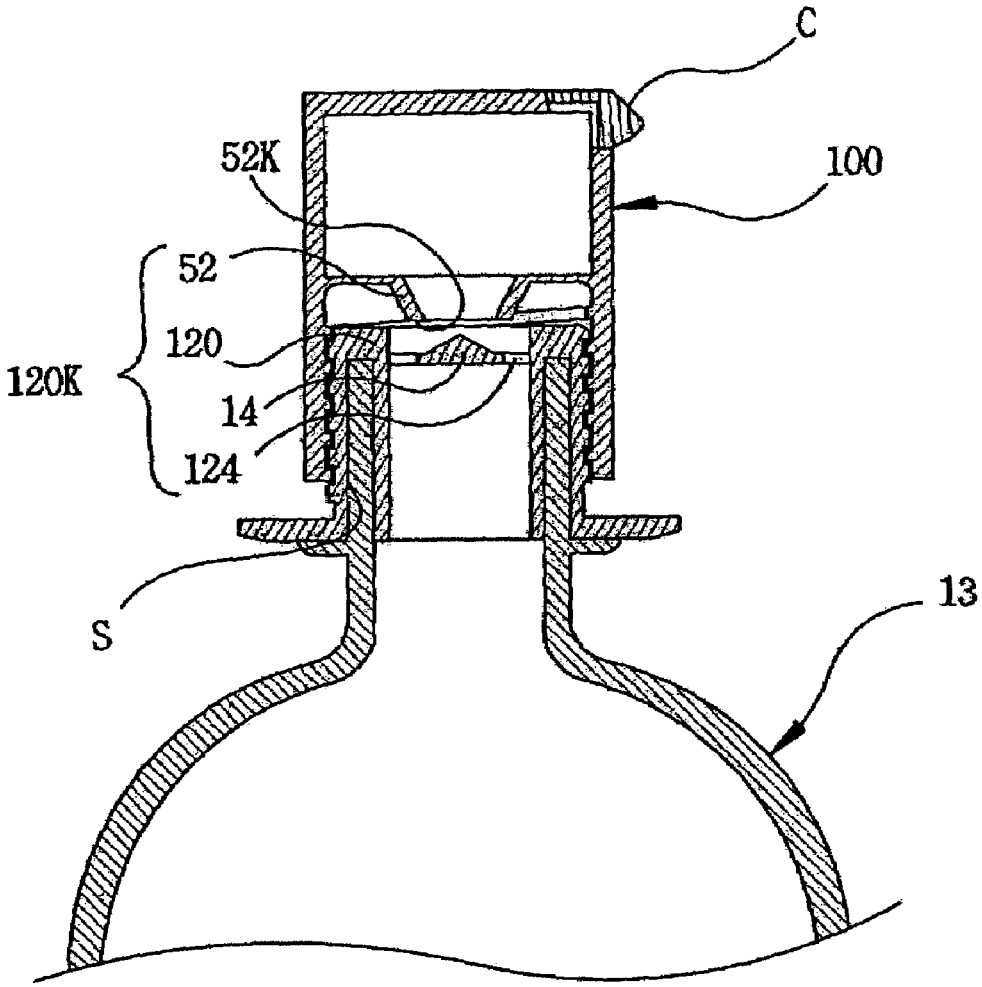
FIGS. 2*a* and 2*b* are sectional views showing the operation of the cap device of FIG. 1*a*, when the assembled cap device is tightened to the mouth of a bottle.
Figure 2B:
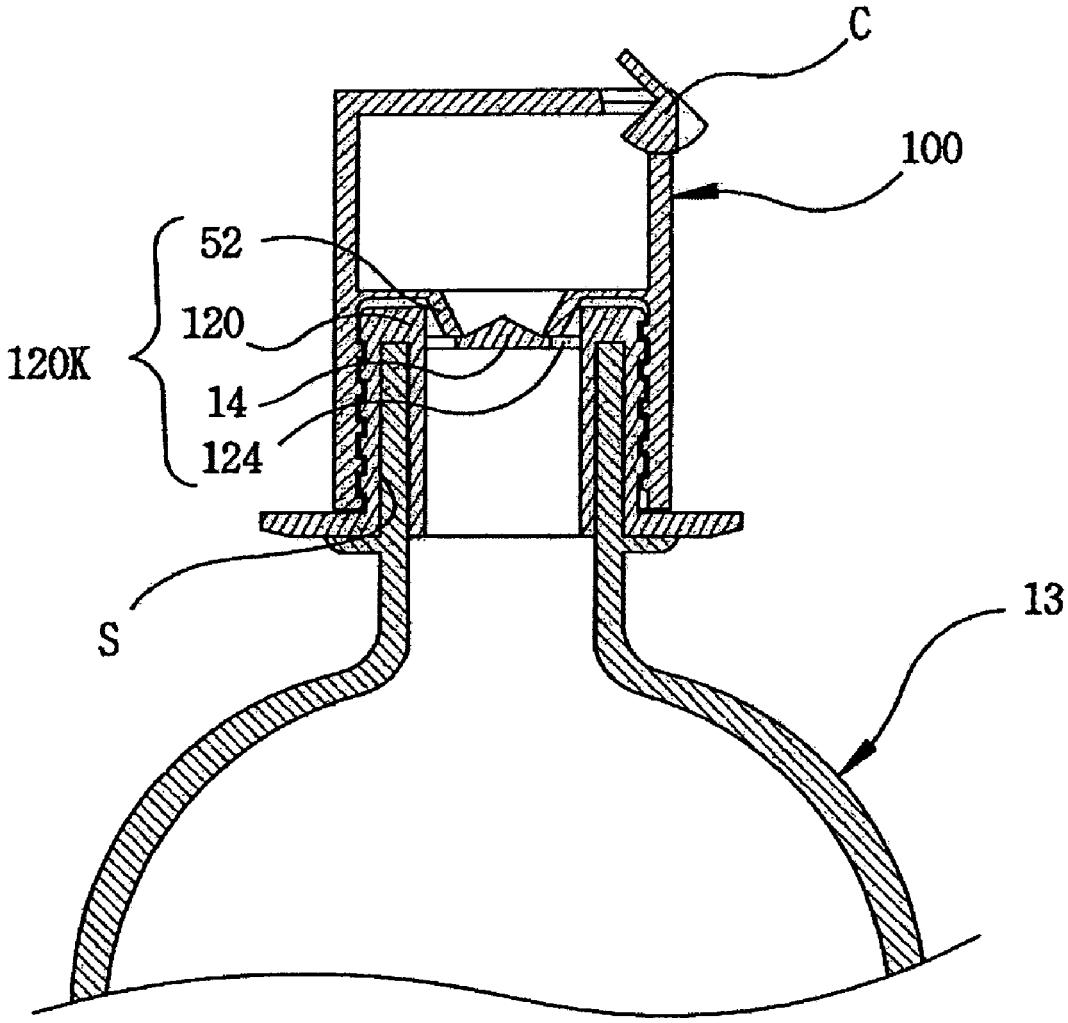
Figure 3A:
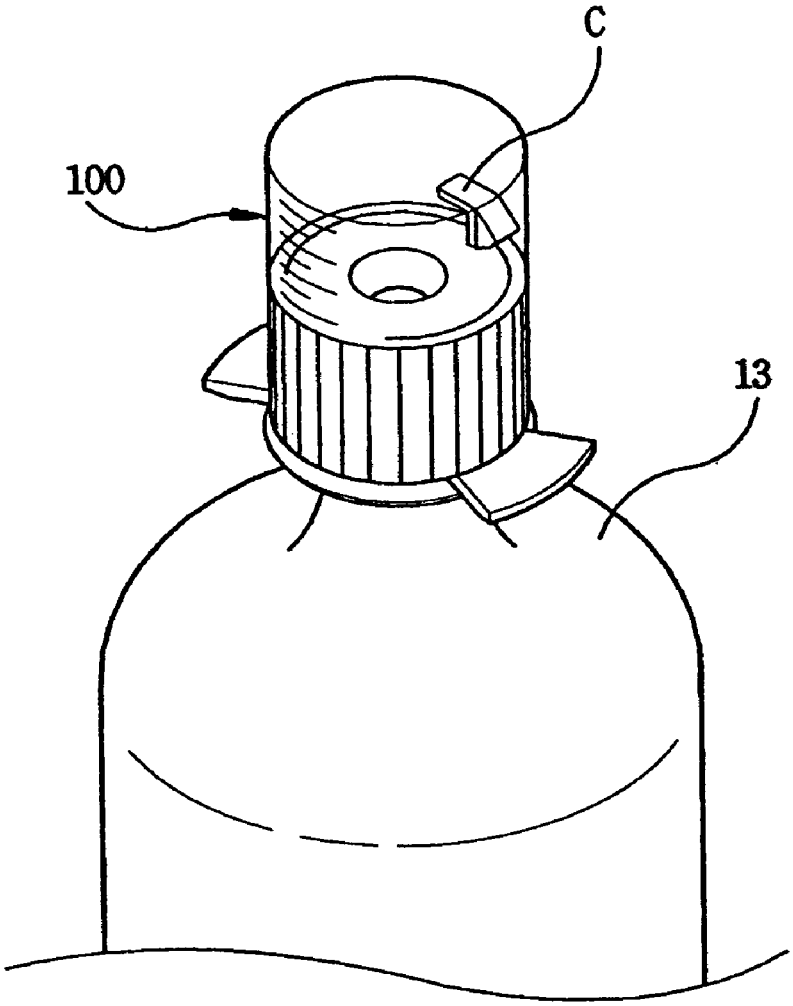
FIGS. 3*a* to 3*c* are perspective views showing the appearance and construction of the cap device of FIG. 1*a*.
Figure 3B:
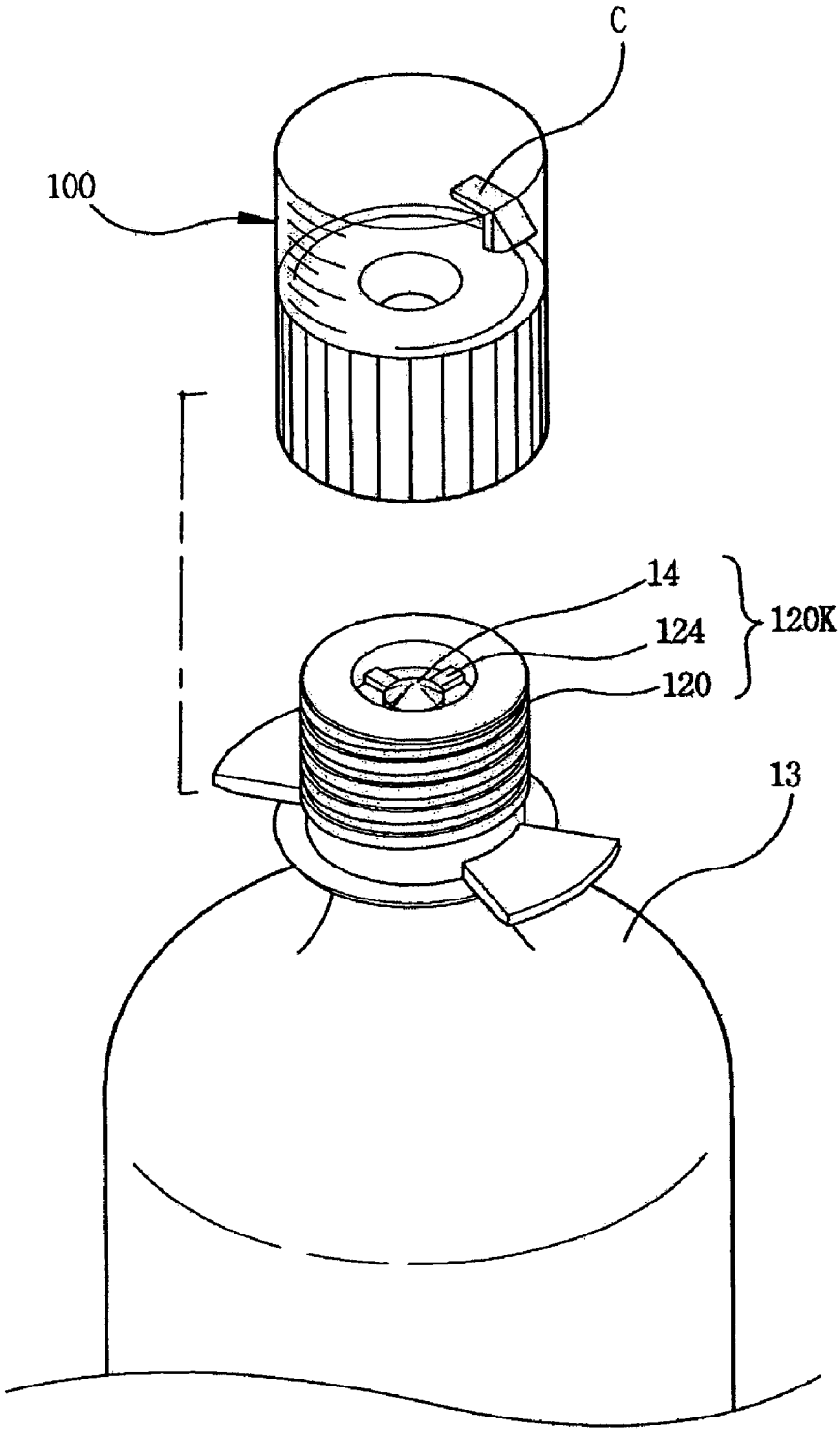
Figure 3C:
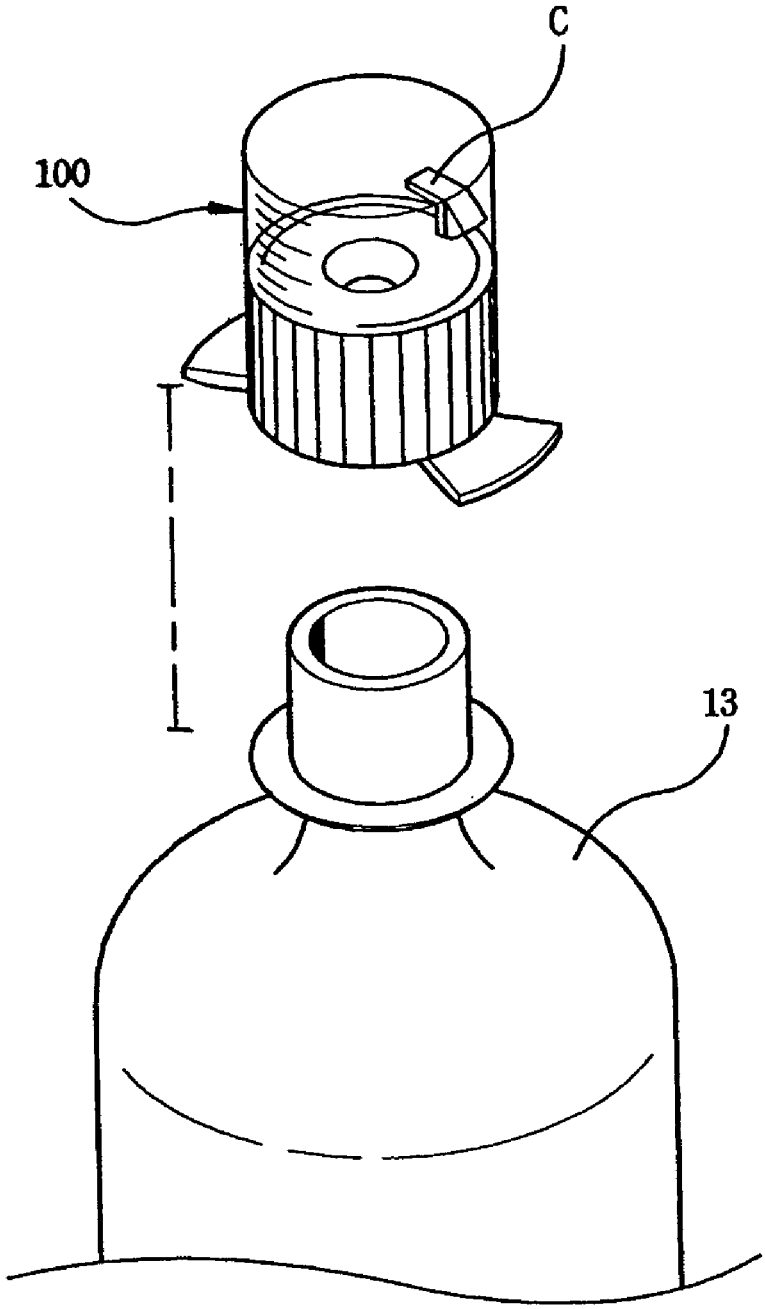

The conical valve part 14 of the valve body 120 is thus brought into close contact with or spaced apart from the lower end 52K of the funnel part 52 of the additive containing unit 100 depending on how much the additive containing unit 100 is tightened onto to the valve body 120, as shown in FIGS. 2*a* and 2*b*. The lower end 52K of the funnel part 52 thus acts as a valve seat. Therefore, it is possible to discharge the additive from the cavity of the additive containing unit 100 into the bottle 13 through a plurality of additive discharging spaces formed between the radial ribs 124. The cap device of the first embodiment thus allows the user to quickly mix a precise amount of the additive with the bottled material to prepare a desired mixture in the bottle 13.

In the cap device according to the first embodiment, a vacuum pressure may act on the surface of the additive contained in the cavity of the additive containing unit 100. In such a case, the additive cannot smoothly flow from the cavity of the additive containing unit 100 into the bottle 13, even when the cavity communicates with the interior of the bottle 13 by an operation of the valve unit 120K. In order to allow the additive to smoothly flow from the cavity into the bottle 13 in response to the communication of the cavity with the interior of the bottle 13, a small vent hole provided with a valve cock "C" to open or close the vent hole is formed at the top surface of the additive containing unit 100. When the valve cock "C" opens the vent hole, atmospheric air is introduced into the cavity through the open vent hole, thereby removing the vacuum pressure from the surface of the additive in the cavity. The additive thus smoothly flows from the cavity into the bottle 13, so that the additive is easily added to the material in the bottle 13 to produce the desired mixture.

After the additive is completely mixed with the bottled material, the additive containing unit 100 and the valve body 120 are removed from the mouth of the bottle 13, thus completely opening the mouth of the bottle 13.

The cap device according to the first embodiment is preferably used with bottles or containers, such as test tubes, which do not have threads on their mouths. In addition, since the conical valve part 14 of the valve body 120 is controlled to be brought into close contact with or spaced apart from the lower end 52K of the funnel part 52, the additive smoothly flows from the cavity of the additive containing unit 100 into the bottle 13 through the additive discharging spaces formed between the radial ribs 124. The user thus quickly mixes the precise amount of the additive with the bottled material to prepare the desired mixture in the bottle 13.

Second Embodiment

Figure 4A:
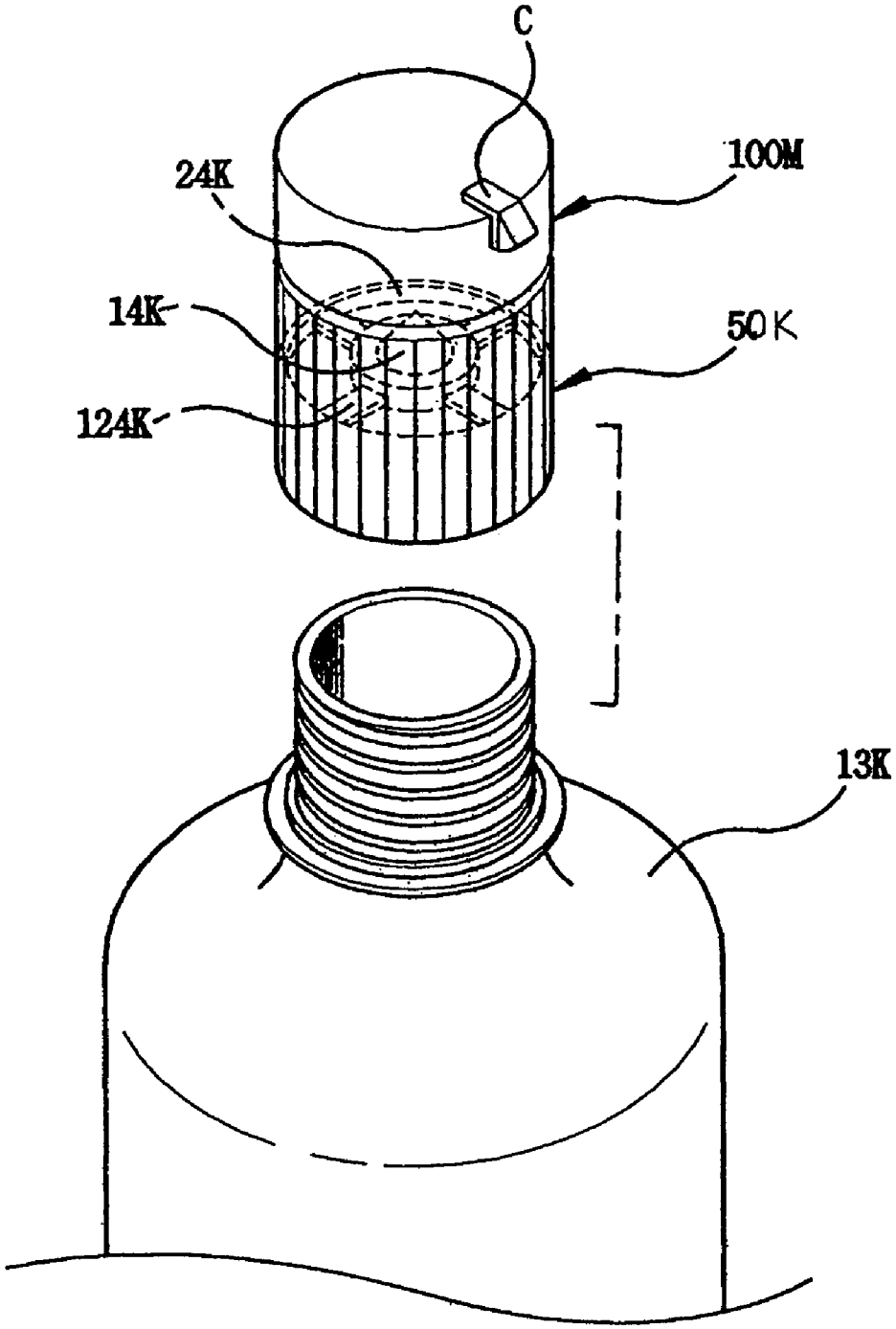
FIGS. 4*a* and 4*b* are an exploded perspective view and a sectional view showing the construction and operation of a cap device for bottles, according to a second embodiment of the present invention, respectively.
Figure 4B:
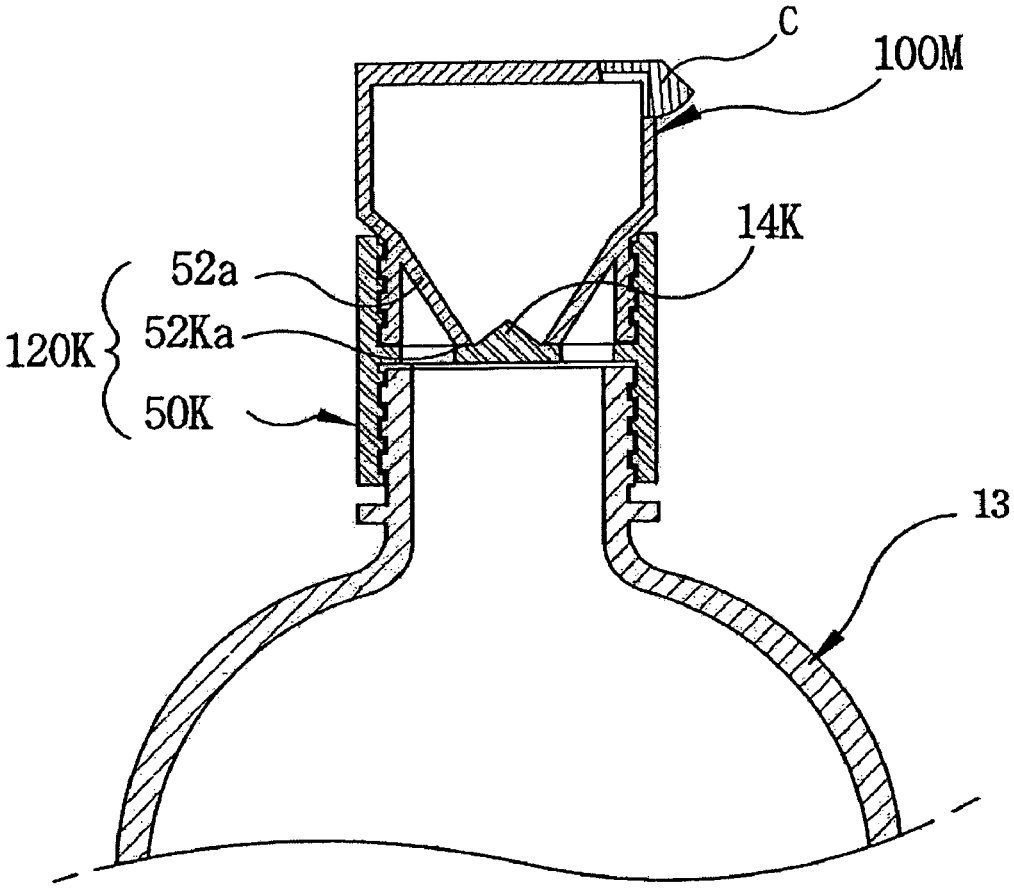

FIGS. 4*a* and 4*b* are views showing a cap device for bottles, according to the second embodiment of the present invention. As shown in the drawings, the cap device according to the second embodiment comprises an additive containing unit 100M, which has external threads at a lower portion thereof and defines a cavity therein to contain an additive. The cap device also has a valve unit 120K acting as a valve means to open or close the cavity of the additive containing unit 100M. The cap device of this second embodiment is used with a bottle 13 having an externally threaded mouth. That is, the valve unit 120K comprises a cap body 50K, which has a conical valve part 14K at an intermediate portion thereof. The valve unit 120K also has a funnel part 52*a* provided in the additive containing unit 100M. The cap body 50K has upper and lower threaded inner surface at positions above and under the conical valve part 14K so that the cap body 50K is tightened at the lower threaded inner surface thereof to the externally threaded mouth of the bottle, and the cap body 50K is assembled at the upper threaded inner surface thereof with the external threads of the additive containing unit 100M such that an open lower end of the funnel part 52*a* is closed by the conical valve part 14K.

The cap body 50K has the conical valve part 14K at the intermediate portion thereof. The additive containing unit 100M defines the cavity therein to contain the additive and has the funnel part 52*a* at its lower portion. The lower end 52Ka of the funnel part 52*a* is brought into close contact with or spaced apart from the conical valve part 14K of the cap body 50K, thus acting as a valve seat. Therefore, it is possible to discharge the additive from the cavity of the additive containing unit 100M into the bottle 13.

The additive containing unit 100M has the external threads at its lower portion corresponding to the funnel part 52*a* so that the additive containing unit 100M is assembled at its external threads with the upper threaded inner surface of the cap body 50K.

The cap device according to the second embodiment is used with bottles having externally threaded mouths. In addition, since the conical valve part 14K of the cap body 50K is controlled to be brought into close contact with or spaced apart from the lower end 52Ka of the funnel part 52*a*, the additive smoothly flows from the cavity of the additive containing unit 100M into the bottle 13. The user thus quickly mixes a precise amount of the additive with the bottled material to prepare a desired mixture in the bottle 13.

As described above, the present invention provides a cap device for bottles, which allows an additive and a bottled material to be maintained in their respective pure states without being mixed together before a user adds the additive to the bottled material, thus being free from physical or chemical problems of degradation in the properties of ingredients, change in colors, and a generation of floating matters and deposits.

The cap device for bottles of this invention contains an additive separate from a bottled material. Therefore, the cap device does not force the user to separately purchase and handle an additive container and a bottle containing a bottled material, thus being convenient to the user, and which is free from excessive consumption of labor, time and natural resources due to the separate production of the containers for additives and capped bottles.

The cap device for bottles of the present invention also allows the user to mix the precise amount of the additive with the bottled material to prepare the mixture so that it is possible to prevent variations in the taste and quality of the mixture in the case of preparing a mixed beverage through the mixing, and to prevent incomplete dissolution of effective ingredients of the additive in the bottled material or a failure of accomplishment of desired medical or chemical effects of the mixture in the case of preparing a mixed medicine or a mixed chemical through the mixing.

The cap device of this invention may be freely designed such that it is used with containers having no threads at the mouths thereof, such as test tubes, and bottles having the threads at the mouths thereof.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A cap device for engagement with a bottle, said cap device comprising:

a valve unit closely and removably fitted over a mouth of said bottle;

an additive containing unit externally and removably engaging with the valve unit, said additive containing unit defining a cavity therein for containing an additive; wherein the valve unit further comprises a cap body having a lower threaded inner surface and an upper threaded inner surface; said lower threaded surface being removably engaged with said mouth of the bottle;

a conical valve part formed at an intermediate portion in the cap body;

a funnel part provided at a lower portion of the additive containing unit, said additive containing unit having a threaded lower portion to removably engage with the upper threaded inner surface of the cap body;

wherein an opening formed at the lower end of the funnel part is closed by the conical valve part when said additive containing unit is tightened completely onto said cap body; and, wherein said lower end of the funnel separates from said conical valve part when said additive containing unit is being removed from said cap body.

2. A bottle having a mouth, said mouth having a threaded outer surface, said bottle comprising:

a cap device for engagement with said bottle, said cap device comprising:

a valve unit closely and removably fitted over said mouth of said bottle;

an additive containing unit externally and removably engaging with the valve unit, said additive containing unit defining a cavity therein for containing an additive; wherein the valve unit further comprises a cap body having a lower threaded inner surface and an upper threaded inner surface; said lower threaded surface being removably engaged with said mouth of the bottle;

a conical valve part formed at an intermediate portion in the cap body;

a funnel part provided at a lower portion of the additive containing unit, said additive containing unit having a threaded lower portion to removably engage with the upper threaded inner surface of the cap body;

wherein an opening formed at the lower end of the funnel part is closed by the conical valve part when said additive containing unit is tightened completely onto said cap body; and, wherein said lower end of the funnel separates from said conical valve part when said additive containing unit is being removed from said cap body.

* * * * *